US009396688B2

(12) United States Patent
Oh

(10) Patent No.: US 9,396,688 B2
(45) Date of Patent: Jul. 19, 2016

(54) IMAGE DISPLAY DEVICE AND METHOD FOR DRIVING THE SAME

(71) Applicant: LG DISPLAY CO., LTD., Seoul (KR)

(72) Inventor: Seung-Cheol Oh, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 53 days.

(21) Appl. No.: 14/098,832

(22) Filed: Dec. 6, 2013

(65) Prior Publication Data

US 2014/0176412 A1 Jun. 26, 2014

(30) Foreign Application Priority Data

Dec. 26, 2012 (KR) ..... 10-2012-0153837

(51) Int. Cl.
*G09G 3/36* (2006.01)
*G09G 5/00* (2006.01)

(52) U.S. Cl.
CPC ..... *G09G 3/3611* (2013.01); *G09G 3/3648* (2013.01); *G09G 3/3688* (2013.01); *G09G 5/001* (2013.01); *G09G 3/3666* (2013.01); *G09G 2310/0281* (2013.01); *G09G 2310/0283* (2013.01)

(58) Field of Classification Search
None
See application file for complete search history.

(56) References Cited

U.S. PATENT DOCUMENTS 7,714,850 B2 * 5/2010 Shiraishi ..... G09G 3/3648 345/204
7,924,256 B2 * 4/2011 Jeon ..... G09G 3/3611 345/100
8,749,535 B2 * 6/2014 Kim ..... G09G 3/3648 345/204
2005/0168429 A1 * 8/2005 Chou ..... G09G 3/3688 345/100
2005/0280622 A1 * 12/2005 Lee ..... G09G 3/3688 345/96
2005/0285842 A1 * 12/2005 Kang ..... G09G 3/3614 345/103
2006/0022603 A1 2/2006 Shiraishi
2006/0071897 A1 * 4/2006 Moon ..... G09G 3/3611 345/98
2007/0132701 A1 * 6/2007 Jeon ..... G09G 3/3611 345/100
2008/0211791 A1 9/2008 Ryu
2008/0246752 A1 * 10/2008 Lee ..... G09G 3/20 345/213
2008/0246755 A1 * 10/2008 Lee ..... G09G 3/20 345/214

(Continued)

FOREIGN PATENT DOCUMENTS

CN 1728208 A 2/2006
CN 1983356 A 6/2007

(Continued)

OTHER PUBLICATIONS

Office Action dated Nov. 17, 2015 for corresponding Chinese Patent Application No. 201310714197.0, 19 pages.

*Primary Examiner* — Dismery Mercedes
(74) *Attorney, Agent, or Firm* — Brinks Gilson & Lione

(57) ABSTRACT

An image display device and a method of driving the same, which reduce the number of transmission/reception lines of image data using a multi-drop intra-panel interface as well as to improve the bandwidth use efficiency. The image display device includes: an image display panel configured to display an image by including a plurality of pixel regions; a plurality of first gate integrated circuits (ICs) located at a first side of the image display panel so as to drive gate lines of the liquid crystal panel; a plurality of data integrated circuits (ICs) configured to drive data lines of the image display panel; and a timing controller configured to arrange image data received from an external part according to odd-th data ICs and even-th data ICs, and sequentially provide the odd-th and even-th arranged image data to the odd-th and even-th data ICs using a multi-drop scheme.

11 Claims, 5 Drawing Sheets

(56) References Cited

U.S. PATENT DOCUMENTS

2009/0015519 A1* 1/2009 Hori ..... G09G 3/20 345/60
2009/0244035 A1* 10/2009 Cho ..... G02F 1/13452 345/204
2009/0284509 A1* 11/2009 Choe ..... G09G 3/2088 345/208
2010/0085084 A1* 4/2010 Kim et al. ..... 327/108
2010/0110045 A1* 5/2010 Fu ..... G09G 3/3611 345/204
2010/0149083 A1* 6/2010 Park et al. ..... 345/99
2010/0225637 A1* 9/2010 Jeon et al. ..... 345/213
2011/0037746 A1* 2/2011 Kim ..... G09G 3/3611 345/211
2013/0222348 A1* 8/2013 Jeong ..... G09G 3/3233 345/204
2014/0009450 A1* 1/2014 Su ..... G09G 5/001 345/204
2014/0160176 A1* 6/2014 Nose et al. ..... 345/690

FOREIGN PATENT DOCUMENTS

CN 102034416 A 4/2011
JP 2004-205901 7/2004
KR 10-0653159 11/2006

* cited by examiner

IMAGE DISPLAY DEVICE AND METHOD FOR DRIVING THE SAME

This application claims the benefit of priority to Korean Patent Application No. 10-2012-0153837, filed on Dec. 26, 2013, which is hereby incorporated by reference as if fully set forth herein.

BACKGROUND

1. Field of the Disclosure

The present disclosure relates to an image display device configured to reduce the number of transmission/reception lines of image data using a multi-drop intra-panel interface as well as to improve the bandwidth use efficiency, and a method for driving the same.

2. Discussion of the Related Art

Recently, a variety of image display devices have been widely used to display various types of digital contents in various ways. General flat-type image display devices include a Liquid Crystal Display (LCD) device, an Organic Light Emitting Display (OLED) device, a Field Emission Display (FED) device, a Plasma Display Panel (PDP), etc.

Image display devices are configured to use an intra-panel interface scheme to achieve data transmission/reception between a driver for driving an image display panel and a controller for controlling the driver.

Typical intra-panel interface schemes include a Reduced Swing Differential Signaling (RSDS) interface based on the multidrop scheme, a mini-Low Voltage Differential Signaling (mini-LVDS) interface, and a Point-to-Point Differential Signaling (PPDS) interface based on a point-to-point scheme.

However, the above-mentioned intra-panel interface schemes need to include a large number of transmission lines for transmitting control signals or data, reduces bandwidth use efficiency, and encounters many problems caused by electromagnetic interference.

In recent times, as large-screen image display devices are configured in the form of a narrow-bezel design or a clear borderless design in response to the increasing demand of consumers who desire to have low-weight and slim-design products, the number of control signals and the number of data transmission lines are increased more and more, such that the bandwidth use efficiency is reduced and the number of problems caused by EMI becomes prominent. In conclusion, there is a need to further reduce the number of control signals and the number of transmission lines.

SUMMARY

An image display device includes: an image display panel configured to display an image by including a plurality of pixel regions; a plurality of first gate integrated circuits (ICs) located at a first side of the image display panel so as to drive gate lines of the liquid crystal panel; a plurality of data integrated circuits (ICs) configured to drive data lines of the image display panel; and a timing controller configured to arrange image data received from an external part according to odd-th data ICs and even-th data ICs, and sequentially provide the odd-th and even-th arranged image data to the odd-th and even-th data ICs using a multi-drop scheme.

In accordance with another embodiment, a method for driving an image display device includes: driving gate lines of an image display panel that is comprised of a plurality of pixel regions to display an image; driving data lines of the image display panel using odd-th and even-th data integrated circuits (ICs) according to a drive timing of the gate lines; and arranging image data received from an external part according to the individual odd-th data ICs and even-th data ICs, and sequentially providing the odd-th and even-th arranged image data to the odd-th and even-th data ICs using a multi-drop scheme.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts. An image display device and a method for driving the same according to embodiments of the present invention will hereinafter be described with reference to the attached drawings.

For example, general flat display devices may include a Liquid Crystal Display (LCD), a Field Emission Display (FED), a Plasma Display Panel (PDP), an Organic Light Emitting Diode (OLED) display), and the like.

For convenience of description and better understanding of the present invention, a liquid crystal display (LCD) device will hereinafter be described as an example of the flat display device.

Figure 1:
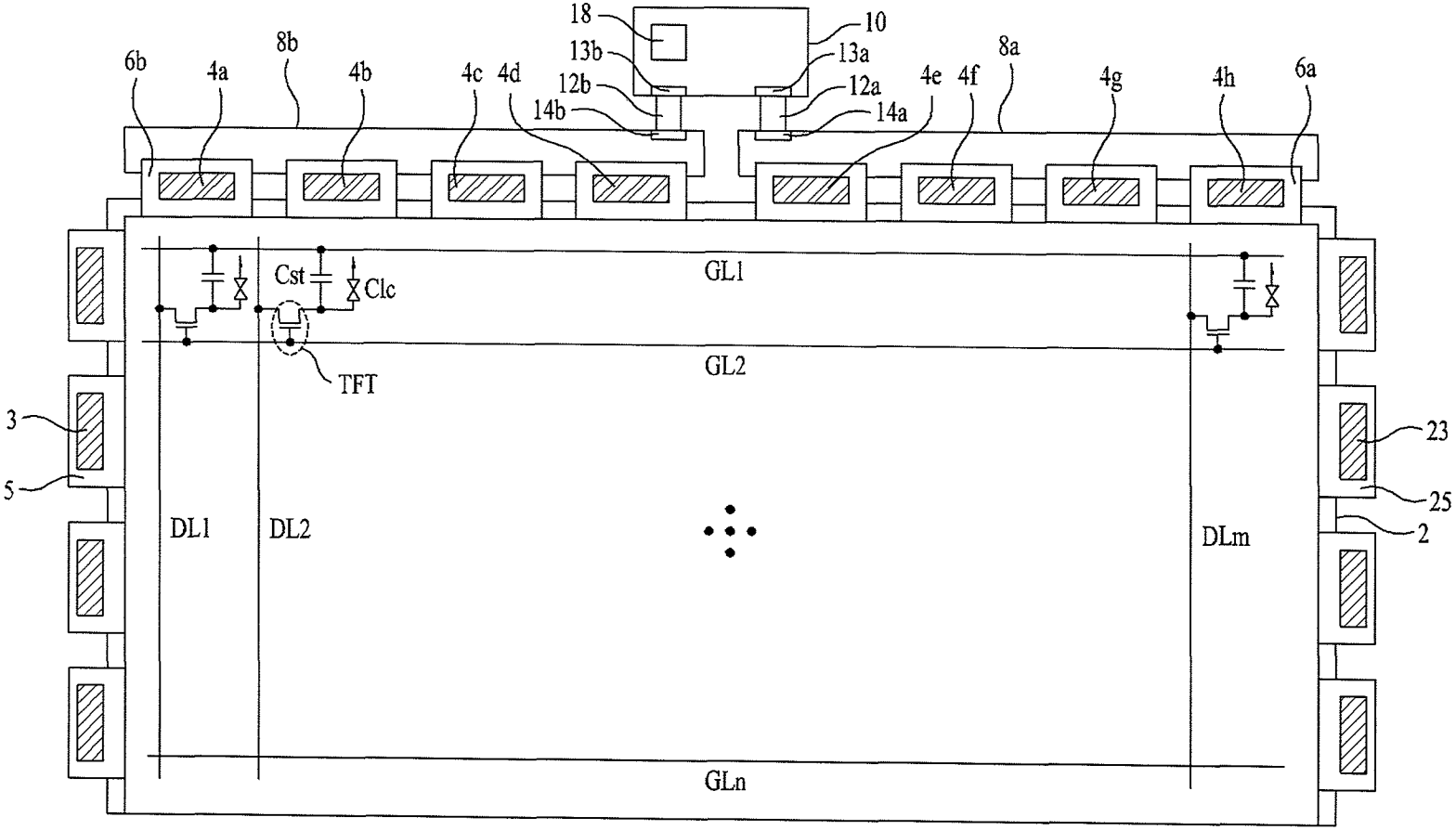
FIG. 1 is a schematic diagram illustrating a liquid crystal display (LCD) device according to an embodiment.

FIG. 1 is a schematic diagram illustrating a liquid crystal display (LCD) device according to an embodiment.

Referring to FIG. 1, the LCD device includes a liquid crystal panel 2 including a plurality of pixel regions so as to display an image; a plurality of first gate ICs located at a first side of the liquid crystal panel so as to drive gate lines (GL1 to GLn) of the liquid crystal panel 2; a second gate IC 23 located at a second side corresponding to the first side of the liquid crystal panel 2 so as to drive the gate lines (GL1 to GLn); a plurality of data ICs (4*a* to 4*h*) for driving data lines (DL1 to DLm) of the liquid crystal panel 2; and a timing controller 18 for arranging image data received from an external part according to the odd-th data ICs (4*a*,4*c*,4*e*,4*g*) and the even-th data ICs (4*b*,4*d*,4*f*,4*h*), and sequentially providing the odd-th and even-th image data to the odd-th and even-th data ICs (4*a* to 4*h*) using a multi-drop scheme.

The liquid crystal panel 2 includes a thin film transistor (TFT) formed in each pixel region defined by a plurality of gate lines (GL1 to GLn) and a plurality of data lines (DL1 to DLm); and a liquid crystal capacitor Clc connected to the TFT. The liquid crystal capacitor Clc includes a pixel electrode includes a pixel electrode connected to the TFT and a common electrode interposed between the pixel electrode and the liquid crystal. The TFT provides an image signal from each of the data lines (DL1 to DLm) to the pixel electrode upon receiving a scan pulse from each of the gate lines (GL1 to GLn). The liquid crystal capacitor Clc is charged with a differential voltage between the image signal applied to the pixel electrode and a reference common voltage applied to the common electrode, and implements a grey level by adjusting optical transmittance according to variation in liquid crystal arrangement in response to the differential voltage. A storage capacitor Cst is connected in parallel to the liquid crystal capacitor Clc so as to maintain a voltage charged in the liquid crystal capacitor Clc until reaching the next data signal. The storage capacitor Cst may be formed by a pixel electrode configured to overlap a previous gate line while interposing an insulation film therebetween, and may also be formed by a pixel electrode configured to overlap a storage line while interposing an insulation film therebetween.

Each of the data ICs (4*a* to 4*h*) is populated into each of data circuit films (6*a*, 6*b*) interposed between a third side of the liquid crystal panel 2 and at least one source Printed Circuit Board (8*a* or 8*b*), such that the corresponding data lines (DL1 to DLm) of a display region matched to the position of the corresponding data IC can be driven, respectively.

The data circuit films 6*a* or 6*b* may be formed of a Tape Carrier Package (TCP) film or a Chip On Flexible Printed Circuit (COF) film. Specifically, the data circuit film 6*a* or 6*b* in which respective data ICs (4*a* to 4*h*) are populated is mounted between at least one source PCB 8*a* or 8*b* and the liquid crystal panel 2 by a Tape Automated Bonding (TAB) scheme or the like. In this case, each of the data ICs (4*a* to 4*h*) is configured to drive the corresponding data lines (DL1 to DLm) of a display region corresponding to the position of the corresponding data IC through the data circuit films (6*a*, 6*b*), a pad portion, etc.

Each of the data ICs (4*a* to 4*h*) is configured to provide an analog image signal to each of the data lines (DL1 to DLm) upon receiving data drive control signals (e.g., a source start pulse (SSP), a source shift clock (SSC), a source output enable (SOE) signal, etc.) from the timing controller 18.

In more detail, the odd-th data ICs (4*a*,4*c*,4*e*,4*g*) may sequentially receive image data of the odd-th display region on the basis of a horizontal line, and the even-th data ICs (4*b*,4*d*,4*f*,4*h*) may sequentially receive image data of the even-th display region on the basis of a horizontal line. After the image data of the odd-th display region corresponding to the odd-th position and the image data of the even-th display region corresponding to the even-th display position have been latched, the latched image data is converted into an analog image voltage (i.e., an analog image signal). The converted image signals are applied to the corresponding data lines (DL1 to DLm) of a display region corresponding to the position of the corresponding image signal.

The position of the odd-th data IC or the position of the even-th data IC may be pre-established or pre-stored, and may be established by a position setting signal or carry signal received from an external part. For example, the position setting signal for setting the odd-th or even-th position may be input as a logic signal composed of at least one bit. The position setting signal may be pre-established or pre-stored according to the position of individual data ICs (4*a* to 4*h*), and may be established and input by an external system or the timing controller 18.

A plurality of first gate ICs 3 is mounted to a first side of the liquid crystal panel 2, so that the gate lines (GL1 to GLn) are sequentially driven. Each first gate IC 3 is populated into a non-display region or a first gate circuit film 5 of the liquid crystal panel 2, so that it is electrically connected to the liquid crystal panel 2. Each first gate IC 3 may receive a gate control signal, etc. from the timing controller 18 through at least one source PCB (8*a*, 8*b*), a data circuit film (6*a*, 6*b*), and the non-display region and the first gate circuit film 5 of the liquid crystal panel 2.

The individual first gate ICs 3 sequentially output a scan pulse or a gate-on voltage to the individual gate lines (GL1 to GLn) upon receiving gate control signals (e.g., a gate start pulse (GSP), a gate shift clock (GSC), a gate output enable (GOE) signal, etc.) from the timing controller 18. In more detail, the first gate ICs 3 may shift the GSP received from the timing controller 18 in response to the GSC signal such that the scan pulse of a gate-on voltage is sequentially applied to the individual gate lines (GL1 to GLn). During a specific time period in which no scan pulse is applied to the individual gate lines (GL1 to GLn), the first gate ICs 3 may provide a gate-off voltage.

A plurality of second gate ICs 23 is located at a second side facing the first side of the liquid crystal panel 2, such that the individual gate lines (GL1 to GLn) are sequentially driven. Here, a plurality of second gate ICs 23 may be selectively formed according to the size of a large-screen liquid crystal panel 2 and the length of individual gate lines (GL1 to GLn). If the liquid crystal panel 2 is small in size, it is not necessary to use the second gate ICs 23. A method for driving each of the second gate ICs 23 is identical to a method for driving each of the first gate ICs 3. The number of data ICs (4*a* to 4*h*) and the number of first and second gate ICs (3, 23) are not limited to the example of FIG. 1. The timing controller 18 may be included in a separate control PCB 10 as shown in FIG. 1, and may be included in any one of the source PCBs (8*a*, 8*b*), such that it controls the data ICs (4*a* to 4*h*) and the first and second gate ICs (3, 23) upon receiving image data and a plurality of synchronous signals from an external part. For example, if the timing controller 18 is included in a separate control PCB 10, the timing controller 18 may output gate and data control signals to the individual source PCBs (8*a*,8*b*) and the individual data circuit films (6*a*, 6*b*) through at least first connector (13*a*,13*b*), at least one cable (12*a*,12*b*), and at least one second connector (14*a*,14*b*).

The timing controller 18 may arrange image data received from an external system according to the driving of the liquid crystal panel 2. Here, the timing controller 18 arranges and divides image data according to the odd-th data ICs (4*a*,4*c*, 4*e*,4*g*) and the even-th data ICs (4*b*,4*d*,4*f*,4*h*), and then sequentially output the multi-drop-based arranged and divided image data to the data ICs (4*a* to 4*h*). In addition, the timing controller 18 may generate the gate and data control signals upon receiving synchronous signals (e.g., a dot clock, a data enable signal, and horizontal and vertical synchronous signals) from an external part, such that it can control the first and second gate ICs (3,23) and the data ICs (4*a*,4*b*). Here, the timing controller 18 may generate a position setting signal composed of at least one bit so as to establish the position of the odd-th data ICs (4*a*,4*c*,4*e*,4*g*) and the position of the even-th data ICs (4*b*,4*d*,4*f*,4*h*), such that it may output the position setting signal to the odd-th and even-th data ICs (4*a* to 4*d*).

Figure 2:
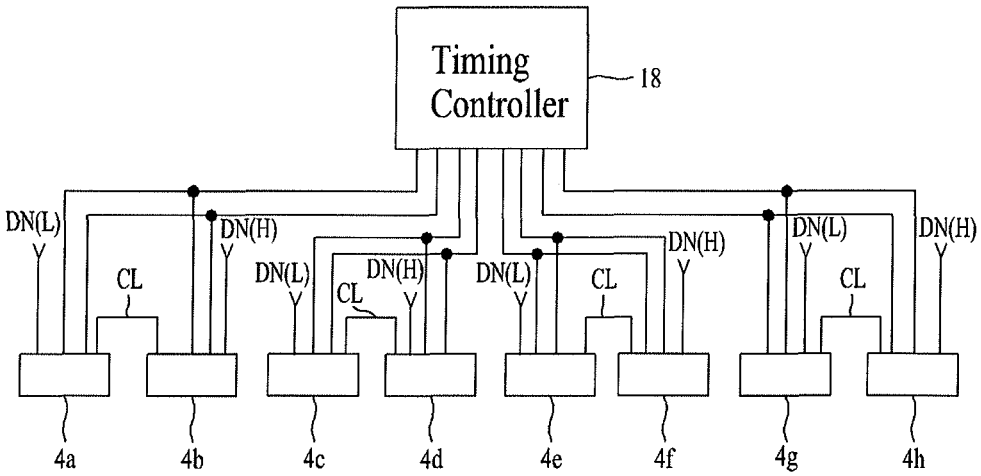
FIG. 2 is a block diagram illustrating signal transmission lines between a timing controller and data integrated circuits (ICs) shown in FIG. 1 according to a first embodiment.
Figure 3:
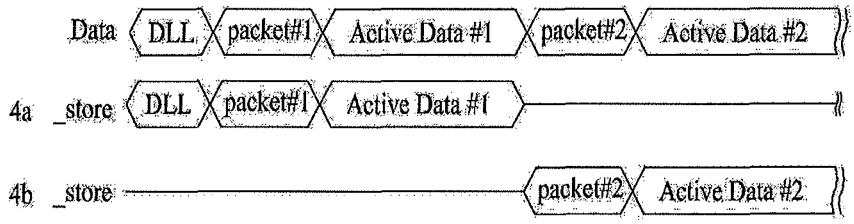
FIG. 3 is a waveform diagram illustrating input/output (I/O) signals and transmission/reception data between the timing controller and the data ICs shown in FIG. 2.

FIG. 2 is a block diagram illustrating signal transmission lines between a timing controller and data integrated circuits (ICs) shown in FIG. 1 according to a first embodiment. FIG. 3 is a waveform diagram illustrating input/output (I/O) signals and transmission/reception data between the timing controller and the data ICs shown in FIG. 2.

Divided signal transmission lines through which the arranged image data is transmitted using the multi-drop scheme are interposed between the odd-th and even-th data ICs (4*a*,4*b*,4*c*,4*d*, . . . ) adjacent to the timing controller 18, and a carry transmission line (CL) is interposed between the odd-th and even-th data ICs (4*a*,4*b*,4*c*,4*d*, . . . ) adjacent to each other.

Accordingly, the timing controller 18 may sequentially output the image data arranged according to the odd-th and even-th data ICs in the order of a pair of the odd-th and even-th data ICs (4*a*,4*b*,4*c*,4*d*, . . . ) adjacent to each other.

The individual odd-th data ICs (4*a*,4*c*,4*e*,4*g*) may sequentially store the odd-th image data from among the arranged image data on the basis of a horizontal line. The individual even-th data ICs (4*b*,4*d*,4*f*,4*h*) may sequentially store the even-th image data from among the arranged image data on the basis of a horizontal line. Here, the arranged image data is obtained according to a carry signal received from the odd-th data ICs (4*a*,4*c*,4*e*,4*g*) adjacent to each other.

In more detail, at least one signal transmission line through which the data control signal and the image data are transmitted is located between the timing controller 18 and each odd-th data IC (4*a*,4*c*,4*e*,4*g*). The signal transmission lines branched from the individual signal transmission lines are connected to the even-th data ICs (4*b*,4*d*,4*f*,4*h*), respectively.

A separate carry transmission line (CL) may be further formed between the odd-th and even-th data ICs (4*a*,4*b*,4*c*, 4*d*, . . . ) adjacent to each other.

Referring to FIG. 3, the timing controller 18 synchronizes a phase delay signal or a delay locked loop (DLL), and outputs a data control signal (packet #1) and the image data (Active Data #1) of a horizontal line, which is arranged and divided according to individual odd-th data ICs (4*a*,4*c*,4*e*,4*g*), to signal transmission lines during the odd-th horizontal time period. In addition, the timing controller 18 outputs a data control signal (packet #2) and the image data (Active Data #2) of a horizontal line, which is arranged and divided according to individual even-th data ICs (4*b*,4*d*,4*f*,4*h*), to the same signal transmission lines during the even-th horizontal time period.

The individual odd-th data ICs (4*a*,4*c*,4*e*,4*g*) may sequentially store image data (Active Data #1) corresponding to a single horizontal line in response to the data control signal (packet #1). Here, the individual odd-th data ICs (4*a*,4*c*,4*e*, 4*g*) may shift the GSP in response to the GSC signal so as to sequentially store the image data (Active Data #1) of a single horizontal line. In addition, the shifted GSP is output to the carry transmission line (CL), so that it can be provided as a carry signal to the neighboring even-th data ICs (4*b*,4*d*,4*f*,4*h*).

If each even-th data IC (4*b*,4*d*,4*f*,4*h*) receives a carry signal from each odd-th data IC (4*a*,4*c*,4*e*,4*g*), the even-th data ICs (4*b*,4*d*,4*f*,4*h*) may sequentially store the even-th image data (Active Data #2) from among the arranged and divided image data in response to the data control signal (packet #2) on the basis of a horizontal line. Here, the individual even-th data ICs (4*b*,4*d*,4*f*,4*h*) may shift the GSP in response to the GSC signal so as to sequentially store the image data (Active Data #2) of a single horizontal line.

Thereafter, the odd-th and even-th data ICs (4*a*,4*b*,4*c*, 4*d*, . . . ) may simultaneously convert the stored horizontal-line image data (Active Data #1 and Active Data #2) into an analog image signal, and provide the analog image signal to the data lines (DL1 to DLm) of a display region matched to the position of the corresponding data IC.

Figure 4:
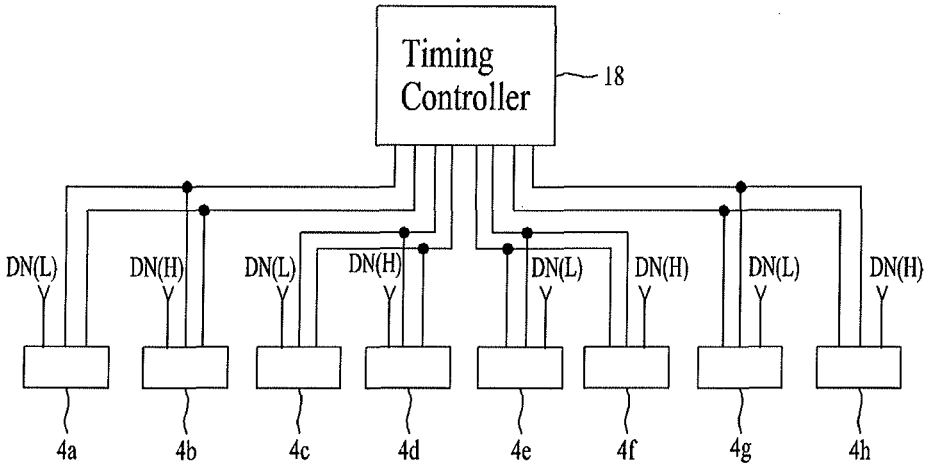
FIG. 4 is a block diagram illustrating signal transmission lines between the timing controller and the data ICs shown in FIG. 1 according to a second embodiment.
Figure 5:
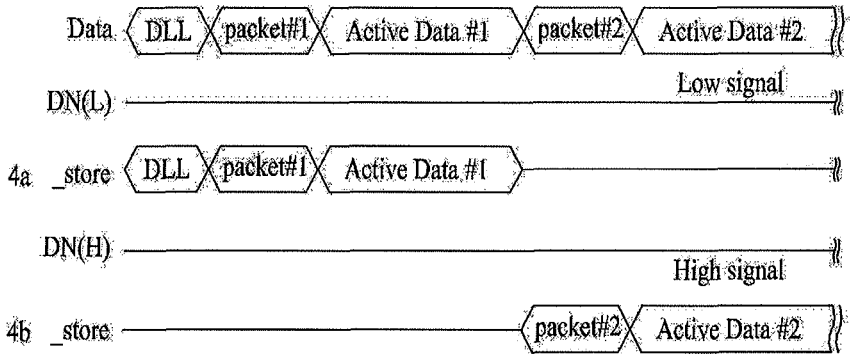
FIG. 5 is a waveform diagram illustrating input/output (I/O) signals and transmission/reception data between the timing controller and the data ICs shown in FIG. 4.

FIG. 4 is a block diagram illustrating signal transmission lines between the timing controller and the data ICs shown in FIG. 1 according to a second embodiment. FIG. 5 is a waveform diagram illustrating input/output (I/O) signals and transmission/reception data between the timing controller and the data ICs shown in FIG. 4.

Referring to FIG. 4, divided signal transmission lines through which the arranged image data is transmitted using the multi-drop scheme are interposed between the odd-th and even-th data ICs (4*a*,4*b*,4*c*,4*d*, . . . ) adjacent to the timing controller 18, and a position setting signal (DN) for setting the odd-th or even-th arrangement position to the odd-th and even-th data ICs (4*a*,4*b*,4*c*,4*d*, . . . ) adjacent to each other is input as a logic signal composed of at least one bit. The timing controller 18 may sequentially output the image data arranged according to the individual odd-th and even-th data ICs in the order of the odd-th and even-th data ICs (4*a*,4*b*,4*c*, 4*d*, . . . ) adjacent to each other.

The individual odd-th data ICs (4*a*,4*c*,4*e*,4*g*) may sequentially store the odd-th image data from among the arranged image data according to the position setting signal (DN) on the basis of a horizontal line, and the individual even-th data ICs (4*b*,4*d*,4*f*,4*h*) may sequentially store the even-th image data from among the arranged image data according to the position setting signal (DN) on the basis of a horizontal line.

In more detail, at least one signal transmission line through which the image data and the data control signal are transmitted is formed between the timing controller 18 and the odd-th data ICs (4*a*,4*c*,4*e*,4*g*). The signal transmission lines branched from the individual signal transmission lines are connected to the even-th data ICs (4*b*,4*d*,4*f*,4*h*), respectively.

Referring to FIG. 5, the timing controller 18 synchronizes a phase delay signal or a delay locked loop (DLL), and outputs a data control signal (packet #1) and the image data (Active Data #1) of a horizontal line, which is arranged and divided according to individual odd-th data ICs (4*a*,4*c*,4*e*,4*g*), to signal transmission lines during the odd-th horizontal time period. In addition, the timing controller 18 outputs a data control signal (packet #2) and the image data (Active Data #2) of a horizontal line, which is arranged and divided according to individual even-th data ICs (4*b*,4*d*,4*f*,4*h*), to the same signal transmission lines during the even-th horizontal time period.

The individual odd-th data ICs (4*a*,4*c*,4*e*,4*g*) may first receive the data control signal (packet #1) according to the position setting signal DN(L) that is provided or established as a low logic level, and may sequentially store image data (Active Data #1) of a single horizontal line according to the data control signal (packet #1). In this case, the individual odd-th data ICs (4*a*,4*c*,4*e*,4*g*) may shift the GSP in response to the GSC so as to sequentially store the image data (Active Data #1) of a single horizontal line.

The individual odd-th data ICs (4*b*,4*d*,4*f*,4*h*) may sequentially store the odd-th image data (Active Data #2) from among the arranged image data using the data control signal (packet #2) according to the position setting signal DN(H), that is provided or established as a high logic level, on the basis of a horizontal line.

Thereafter, the odd-th and even-th data ICs (4*a*,4*b*,4*c*, 4*d*, . . . ) may simultaneously convert the stored horizontal-line image data (Active Data #1 and Active Data #2) into an analog image signal, and provide the analog image signal to the data lines (DL1 to DLm) of a display region matched to the position of the corresponding data IC.

Figure 6:
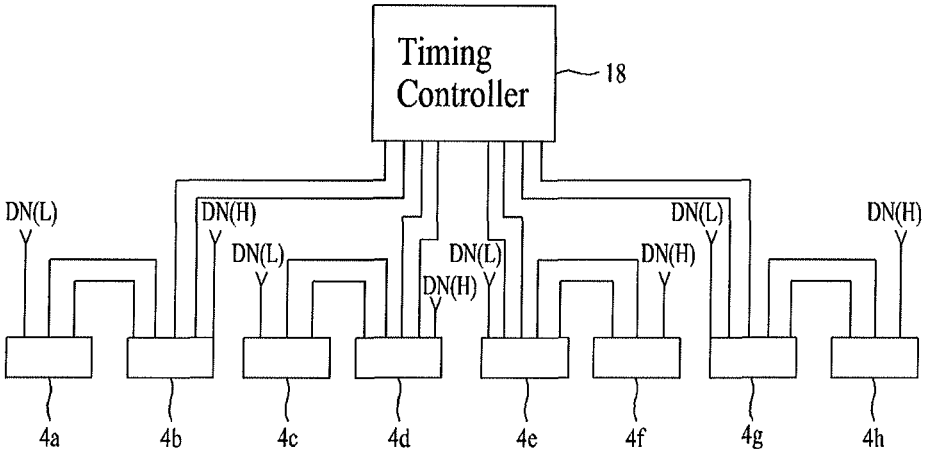
FIG. 6 is a block diagram illustrating signal transmission lines between the timing controller and the data ICs shown in FIG. 1 according to a third embodiment.
Figure 7:
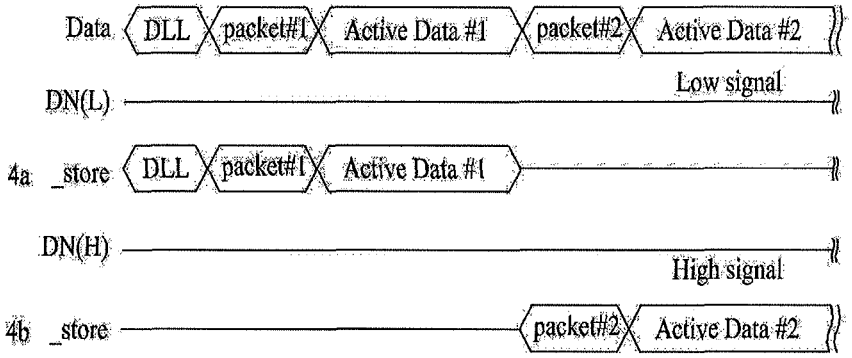
FIG. 7 is a waveform diagram illustrating input/output (I/O) signals and transmission/reception data between the timing controller and the data ICs shown in FIG. 6.

FIG. 6 is a block diagram illustrating signal transmission lines between the timing controller and the data ICs shown in FIG. 1 according to a third embodiment. FIG. 7 is a waveform diagram illustrating input/output (I/O) signals and transmission/reception data between the timing controller and the data ICs shown in FIG. 6.

Referring to FIG. 6, signal transmission lines for transmission of the arranged image data are interposed between the timing controller 18 and each data IC (4*b*,4*d*,4*e*,4*g*) located more adjacent to the timing controller 18 from among the odd-th and even-th data ICs (4*a*,4*b*,4*c*,4*d*, . . . ) adjacent to each other. The individual remaining data ICs (4*a*,4*c*,4*f*,4*h*) not connected to the signal transmission lines are respectively cascaded to the neighbor data ICs (4*b*,4*d*,4*e*,4*g*) connected to the signal transmission lines. In this case, the position setting signal (DN) for establishing the odd-th or even-th position may be self-established in each of the odd-th and even-th data ICs (4*a*,4*b*,4*c*,4*d*, . . . ) adjacent to each other, or may be input as a logic signal composed of at least one bit.

Accordingly, the timing controller 18 may sequentially output the image data arranged according to the odd-th and even-th data ICs in the order of a pair of the odd-th and even-th data ICs (4*a*,4*b*,4*c*,4*d*, . . . ) adjacent to each other.

The individual odd-th data ICs (4*a*,4*c*,4*e*,4*g*) may sequentially store the odd-th image data from among the arranged image data according to the position setting signal (DN) on the basis of a horizontal line. The individual even-th data ICs (4*b*,4*d*,4*f*,4*h*) may sequentially store the even-th image data from among the arranged image data according to the position setting signal (DN) on the basis of a horizontal line.

In more detail, the individual data ICs (4*b*,4*d*,4*e*,4*g*) located more adjacent to the timing controller from among the odd-th and even-th data ICs (4*a*,4*b*,4*c*,4*d*, . . . ) adjacent to each other are connected to the timing controller 18 through signal transmission lines. In contrast, the individual remaining data ICs (4*a*,4*c*,4*f*,4*h*) not connected to the signal transmission lines are respectively cascaded to the neighbor data ICs (4*b*,4*d*,4*e*,4*g*) connected to the signal transmission lines so as to sequentially receive the control signal or image data in series, such that the remaining data ICs (4*a*,4*c*,4*f*,4*h*) are respectively connected to separate signal transmission lines.

Referring to FIG. 7, the timing controller 18 synchronizes a phase delay signal or a delay locked loop (DLL), and outputs a data control signal (packet #1) and the image data (Active Data #1) of a horizontal line, which is arranged and divided according to individual odd-th data ICs (4*a*,4*c*,4*e*,4*g*), to signal transmission lines during the odd-th horizontal time period. In addition, the timing controller 18 outputs a data control signal (packet #2) and the image data (Active Data #2) of a horizontal line, which is arranged and divided according to individual even-th data ICs (4*b*,4*d*,4*f*,4*h*), to the same signal transmission lines during the even-th horizontal time period.

The individual odd-th data ICs (4*a*,4*c*,4*e*,4*g*) may be operated according to the odd-th data control signal (packet #1) that is provided or established as a low logic level, and may sequentially store image data (Active Data #1) of a single horizontal line according to the data control signal (packet #1). In this case, the individual odd-th data ICs (4*a*,4*c*,4*e*,4*g*) may shift the GSP in response to the GSC so as to sequentially store the image data (Active Data #1) of a single horizontal line.

The individual odd-th data ICs (4*b*,4*d*,4*f*,4*h*) may sequentially store the odd-th image data (Active Data #2) from among the arranged image data using the data control signal (packet #2) according to the position setting signal DN(H), that is provided or established as a high logic level, on the basis of a horizontal line.

Thereafter, the odd-th and even-th data ICs (4*a*,4*b*,4*c*, 4*d*, . . . ) may simultaneously convert the stored horizontal-line image data (Active Data #1 and Active Data #2) into an analog image signal, and provide the analog image signal to the data lines (DL1 to DLm) of a display region matched to the position of the corresponding data IC.

In this way, after the image data is applied to the individual data ICs (4*b*,4*d*,4*e*,4*g*) located more adjacent to the timing controller 18 from among the odd-th and even-th data ICs (4*a*,4*b*,4*c*,4*d*, . . . ) adjacent to each other, if the image data is transferred to the remaining data ICs (4*a*,4*c*,4*f*,4*h*) adjacent to each other, the risk caused by reflective waves and the electromagnetic interference (EMI) can be reduced.

Figure 8:
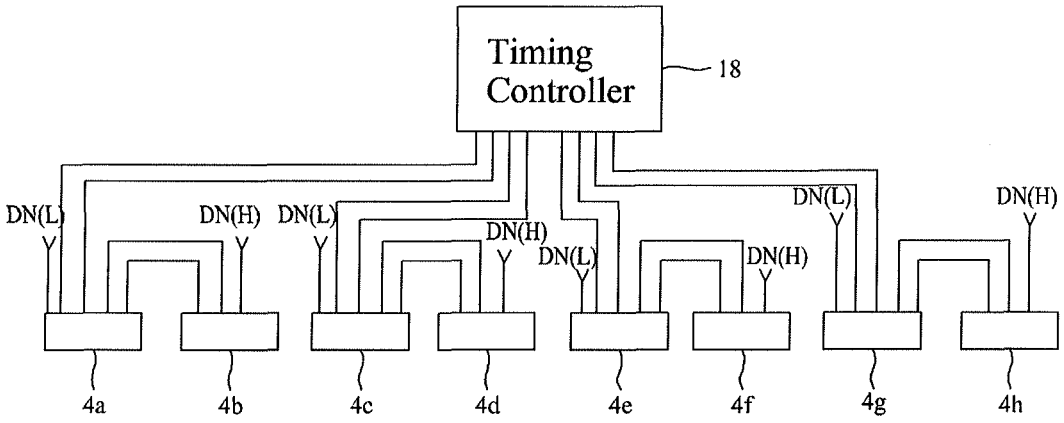
FIG. 8 is a block diagram illustrating signal transmission lines between the timing controller and the data ICs shown in FIG. 1 according to a fourth embodiment.
Figure 9:
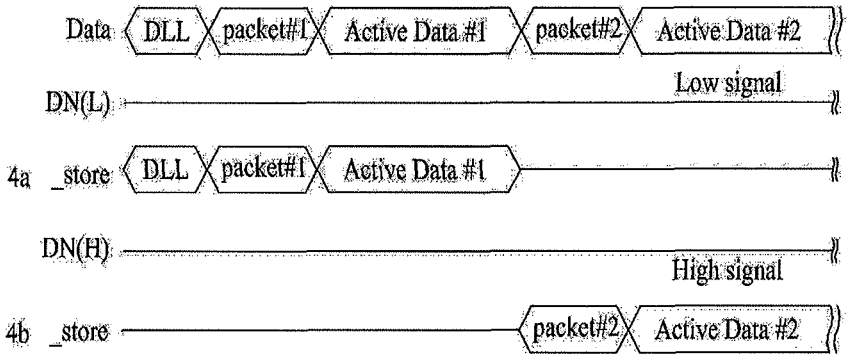
FIG. 9 is a waveform diagram illustrating input/output (I/O) signals and transmission/reception data between the timing controller and the data ICs shown in FIG. 8.

FIG. 8 is a block diagram illustrating signal transmission lines between the timing controller and the data ICs shown in FIG. 1 according to a fourth embodiment. FIG. 9 is a waveform diagram illustrating input/output (I/O) signals and transmission/reception data between the timing controller and the data ICs shown in FIG. 8.

Signal transmission lines through which the arranged image data is transmitted are interposed between the timing controller 18 and the odd-th data ICs (4*a*,4*c*,4*e*,4*g*), and the even-th data ICs (4*b*,4*d*,4*f*,4*h*) are respectively cascaded to the individual odd-th data ICs (4*a*,4*c*,4*e*,4*g*) adjacent to each other through separate signal transmission lines. In this case, the position setting signal (DN) for establishing the odd-th or even-th position may be pre-stored in the individual odd-th and even-th data ICs (4*a*,4*b*,4*c*,4*d*, . . . ) adjacent to each other, and may be input as a logic signal composed of at least one bit.

Accordingly, the timing controller 18 may sequentially output the image data arranged according to the odd-th and even-th data ICs in the order of a pair of the odd-th and even-th data ICs (4*a*,4*b*,4*c*,4*d*, . . . ) adjacent to each other.

The individual odd-th data ICs (4*a*,4*c*,4*e*,4*g*) may sequentially store the odd-th image data from among the arranged image data according to the position setting signal (DN) on the basis of a horizontal line. The individual even-th data ICs (4*b*,4*d*,4*f*,4*h*) may sequentially store the even-th image data from among the arranged image data according to the position setting signal (DN) on the basis of a horizontal line.

In more detail, the odd-th data ICs (4*a*,4*c*,4*d*,4*e*) are connected to the timing controller 18 through signal transmission lines. In contrast, the even-th data ICs (4*b*,4*d*,4*f*,4*h*) not connected to the signal transmission lines are respectively cascaded to the neighbor odd-th data ICs (4*a*,4*c*,4*d*,4*e*) so as to sequentially receive the control signal or image data in series, such that the even-th data ICs (4*b*,4*d*,4*f*,4*h*) are respectively connected to the signal transmission lines.

Referring to FIG. 9, the timing controller 18 synchronizes a phase delay signal or a delay locked loop (DLL), and outputs a data control signal (packet #1) and the image data (Active Data #1) of a horizontal line, which is arranged and divided according to individual odd-th data ICs (4*a*,4*c*,4*e*,4*g*), to signal transmission lines during the odd-th horizontal time period. In addition, the timing controller 18 outputs a data control signal (packet #2) and the image data (Active Data #2) of a horizontal line, which is arranged and divided according to individual even-th data ICs (4*b*,4*d*,4*f*,4*h*), to the same signal transmission lines during the even-th horizontal time period.

The individual odd-th data ICs (4*a*,4*c*,4*e*,4*g*) may be operated according to the position setting signal DN(L) that is provided or established as a low logic level, and may sequentially store image data (Active Data #1) of a single horizontal line according to the odd-th data control signal (packet #1). In this case, the individual odd-th data ICs (4*a*,4*c*,4*e*,4*g*) may shift the GSP in response to the GSC so as to sequentially store the image data (Active Data #1) of a single horizontal line.

The individual odd-th data ICs (4*b*,4*d*,4*f*,4*h*) may sequentially store the odd-th image data (Active Data #2) from among the arranged image data using the even-th data control signal (packet #2) according to the position setting signal DN(H), that is provided or established as a high logic level, on the basis of a horizontal line.

Thereafter, the odd-th and even-th data ICs (4*a*,4*b*,4*c*, 4*d*, . . . ) may simultaneously convert the stored horizontal-line image data (Active Data #1 and Active Data #2) into an analog image signal, and provide the analog image signal to the data lines (DL1 to DLm) of a display region matched to the position of the corresponding data IC.

In this way, after the image data is applied to the individual data ICs (4*b*,4*d*,4*e*,4*g*) located more adjacent to the timing controller 18 from among the odd-th and even-th data ICs (4*a*,4*b*,4*c*,4*d*, . . . ) adjacent to each other, if the image data is transferred to the remaining data ICs (4*a*,4*c*,4*f*,4*h*) adjacent to each other, the risk caused by reflective waves and the electromagnetic interference (EMI) can be reduced.

As is apparent from the above description, the image display device and the method for driving the same according to the embodiments can reduce the number of transmission/reception lines of image data using a multi-drop intra-panel interface, and can simplify an output configuration of a clock signal. As a result, the bandwidth use efficiency can be improved and electromagnetic interference (EMI) can be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An image display device comprising:

an image display panel configured to display an image and including a plurality of pixel regions;

a plurality of first gate integrated circuits (ICs) located at a first side of the image display panel so as to drive gate lines of the liquid crystal panel;

a plurality of data integrated circuits (ICs) configured to drive data lines of the image display panel; and a timing controller configured to arrange image data received from an external part according to odd-th data ICs and even-th data ICs, and sequentially provide the odd-th and even-th arranged image data to the odd-th and even-th data ICs using a multi-drop scheme, wherein adjacent odd-th and even-th data ICs form a pair, the adjacent odd-th and even-th data ICs in each pair receive the odd-th and even-th arranged image data directly from the timing controller through a same signal transmission line and in different time periods, wherein a position of the odd-th data IC or a position of the even-th data IC is established by a position setting signal received from an external system or the timing controller, the position setting signal being a logic signal composed of at least one bit, and wherein the odd-th and even-th arranged image data from the same signal transmission line are digital data, are sequentially saved in the odd-th and even-th data ICs in the different time periods, and are simultaneously converted into analog image signals, the odd-th and even-th data ICs providing the analog image signals to the data lines of a display region matched to the position of the corresponding data ICs.

2. The image display device according to claim 1, further comprising:

divided signal transmission lines through which the arranged image data is transmitted using the multi-drop scheme, configured to be located between paired odd-th and even-th data ICs adjacent to the timing controller; and a carry transmission line located between the paired odd-th and even-th data ICs adjacent to each other, wherein the timing controller is configured to sequentially output the arranged image data for each of the odd-th and even-th data ICs in the order of paired odd-th and even-th data ICs adjacent to each other, the respective odd-th data ICs are configured to sequentially store the odd-th image data from among the arranged image data on the basis of a horizontal line, and the respective even-th data ICs are configured to sequentially store the even-th image data from among the arranged data on the basis of a horizontal line according to a carry signal from the adjacent odd-th data IC through the carry transmission line.

3. The image display device according to claim 1, further comprising:

divided signal transmission lines through which the arranged image data is transmitted using the multi-drop scheme, configured to be located between paired odd-th and even-th data ICs adjacent to the timing controller, wherein the position setting signal for setting the odd-th or even-th position is input to each of paired odd-th even-th data ICs adjacent to each other, the timing controller is configured to sequentially output the arranged image data for each of the odd-th and even-th data ICs in the order of paired odd-th and even-th data ICs adjacent to each other, the respective odd-th data ICs are configured to sequentially store the odd-th image data from among the arranged image data on the basis of a horizontal line according to the position setting signal, and the respective even-th data ICs are configured to sequentially store the even-th image data from among the arranged image data on the basis of a horizontal line according to the position setting signal.

4. The image display device according to claim 1, wherein one of odd-th and even-th data ICs in each pair receives a carry signal from the other one of the odd-th and even-th data ICs so that the odd-th and even-th data ICs in each pair simultaneously convert the stored image data into an analog image signal.

5. The image display device according to claim 1, wherein the position setting signal is pre-established in each of the odd-th and even-th data ICs.

6. The image display device according to claim 1, wherein the position setting signal is transmitted to the odd-th and even-th data ICs via separate signal lines different from the signal transmission line.

7. An image display device comprising:

an image display panel configured to display an image and including a plurality of pixel regions;

a plurality of first gate integrated circuits (ICs) located at a first side of the image display panel so as to drive gate lines of the liquid crystal panel;

a plurality of data integrated circuits (ICs) configured to drive data lines of the image display panel; and a timing controller configured to arrange image data received from an external part according to odd-th data ICs and even-th data ICs, and sequentially provide the odd-th and even-th arranged image data to the odd-th and even-th data ICs using a multi-drop scheme, signal transmission lines through which the arranged image data is transmitted, configured to be located between the timing controller and the odd-th data ICs, wherein the even-th data ICs are cascaded to the adjacent odd-th data ICs paired with the even-th data ICs in such a manner that the even-th data ICs are respectively connected to separate signal transmission lines, a position setting signal for setting the odd-th or even-th position is pre-stored in each of the paired odd-th and even-th data ICs adjacent to each other, and is input as a logic signal composed of at least one bit, the timing controller is configured to sequentially output the arranged image data for each of the odd-th and even-th data ICs in the order of paired odd-th and even-th data ICs adjacent to each other, the respective odd-th data ICs are configured to sequentially store the odd-th image data from among the arranged image data on the basis of a horizontal line according to the position setting signal, and the respective even-th data ICs are configured to sequentially store the even-th image data from among the arranged image data on the basis of a horizontal line according to the position setting signal, wherein the timing controller outputs the odd-th arranged image data to the odd-th data ICs in a first time period and outputs the even-th arranged image data to the even-th data ICs through the adjacent odd-th data IC in a second time period, wherein the odd-th and even-th arranged image data from the same signal transmission line are digital data, are sequentially saved in the odd-th and even-th data ICs in the different time periods, and are simultaneously converted into analog image signals, the odd-th and even-th data ICs providing the analog image signals to the data lines of a display region matched to the position of the corresponding data ICs.

8. A method for driving an image display device comprising:

driving gate lines of an image display panel that is comprised of a plurality of pixel regions to display an image;

driving data lines of the image display panel using odd-th and even-th data integrated circuits (ICs) according to a drive timing of the gate lines; and arranging image data received from an external part according to the individual odd-th data ICs and even-th data ICs, and sequentially providing the odd-th and even-th arranged image data to the odd-th and even-th data ICs using a multi-drop scheme, wherein adjacent odd-th and even-th data ICs form a pair, the adjacent odd-th and even-th data ICs in each pair receive the odd-th and even-th arranged image data from the timing controller through a same signal transmission line and in different time periods, wherein a position of the odd-th data IC or a position of the even-th data IC is established by a position setting signal received from an external system or the timing controller, the position setting signal being a logic signal composed of at least one bit, and wherein the odd-th and even-th arranged image data from the same signal transmission line are digital data, are sequentially saved in the odd-th and even-th data ICs in the different time periods, and are simultaneously converted into analog image signals, the odd-th and even-th data ICs providing the analog image signals to the data lines of a display region matched to the position of the corresponding data ICs.

9. The method according to claim 8, wherein:

divided signal transmission lines through which the arranged image data is transmitted using the multi-drop scheme are located between paired odd-th and even-th data ICs adjacent to the timing controller; and a carry transmission line is located between the paired odd-th and even-th data ICs adjacent to each other, wherein the sequential providing of the arranged image data includes:

sequentially outputting the arranged image data for each of the odd-th and even-th data ICs in the order of paired odd-th and even-th data ICs adjacent to each other, allowing the respective odd-th data ICs to sequentially store the odd-th image data from among the arranged image data on the basis of a horizontal line, and providing a self-generated carry signal to the even-th data ICs adjacent to the odd-th data ICs, and allowing the respective even-th data ICs to sequentially store the even-th image data from among the arranged image data on the basis of a horizontal line according to a carry signal from the adjacent odd-th data IC.

10. The method according to claim 8, wherein:

divided signal transmission lines through which the arranged image data is transmitted using the multi-drop scheme are located between paired odd-th and even-th data ICs adjacent to the timing controller; and a position setting signal for setting the odd-th or even-th position is input as a logic signal composed of at least one bit to each of paired odd-th even-th data ICs adjacent to each other, wherein the sequential providing of the arranged image data includes:

sequentially outputting the arranged image data for each of the odd-th and even-th data ICs in the order of paired odd-th and even-th data ICs adjacent to each other, allowing the respective odd-th data ICs to sequentially store the odd-th image data from among the arranged image data on the basis of a horizontal line according to the position setting signal, and allowing the respective even-th data ICs to sequentially store the even-th image data from among the arranged image data on the basis of a horizontal line according to the position setting signal.

11. A method for driving an image display device comprising:

driving gate lines of an image display panel that is comprised of a plurality of pixel regions to display an image;

driving data lines of the image display panel using odd-th and even-th data integrated circuits (ICs) according to a drive timing of the gate lines; and arranging image data received from an external part according to the individual odd-th data ICs and even-th data ICs, and sequentially providing the odd-th and even-th arranged image data to the odd-th and even-th data ICs using a multi-drop scheme, wherein:

signal transmission lines through which the arranged image data is transmitted are located between the timing controller and the odd-th data ICs, the even-th data ICs are cascaded to the adjacent odd-th data ICs paired with the even-th data ICs in such a manner that the even-th data ICs are respectively connected to separate signal transmission lines, a position setting signal for setting the odd-th or even-th position is pre-stored in each of the paired odd-th and even-th data ICs adjacent to each other, and is input as a logic signal composed of at least one bit, wherein the sequential providing of the arranged image data includes:

sequentially outputting the arranged image data for each of the odd-th and even-th data ICs in the order of paired odd-th and even-th data ICs adjacent to each other, outputting, by the timing controller, the odd-th arranged image data to the odd-th data ICs in a first time period;

outputting, by the timing controller, the even-th arranged image data to the even-th data ICs through the odd-th data ICs in a second time period, allowing the respective odd-th data ICs to sequentially store the odd-th image data from among the arranged image data on the basis of a horizontal line according to the position setting signal, and allowing the respective even-th data ICs to sequentially store the even-th image data from among the arranged image data on the basis of a horizontal line according to the position setting signal, wherein the odd-th and even-th arranged image data from the same signal transmission line are digital data, are sequentially saved in the odd-th and even-th data ICs in the different time periods and are simultaneously converted into analog image signals, the odd-th and even-th data ICs providing the analog image signals to the data lines of a display region matched to the position of the corresponding data ICs.

* * * * *